United States Patent [19]

Zambolin et al.

[11] 3,999,749

[45] Dec. 28, 1976

[54] AUTOMATIC DOCUMENT FEED DEVICE

[75] Inventors: Adriano Zambolin, Ivrea (Turin); Dario Bisone, Montalto Dora (Turin), both of Italy

[73] Assignee: Ing. C. Olivetti & C., S.p.A., Ivrea (Turin), Italy

[22] Filed: July 11, 1975

[21] Appl. No.: 595,087

[30] Foreign Application Priority Data

Sept. 18, 1974 Italy ..... 69813/74

[52] U.S. Cl. ..... 271/246; 271/274

[51] Int. Cl.[2] ..... B65H 9/06

[58] Field of Search ..... 271/246, 245, 247, 274, 271/273

[56] References Cited

UNITED STATES PATENTS

| | | | |
|---|---|---|---|
| 1,299,386 | 4/1919 | Schreck | 271/274 |
| 2,114,108 | 4/1938 | Hormel | 271/246 |
| 3,005,537 | 10/1961 | Schmeck et al. | 271/273 X |
| 3,576,163 | 4/1971 | Lawson | 271/274 X |
| 3,630,519 | 12/1971 | Spear | 271/246 |

*Primary Examiner*—Johnny D. Cherry
*Assistant Examiner*—Bruce H. Stoner, Jr.

[57] ABSTRACT

An automatic passbook feeding device, suitable for an accounting machine, having a pair of parallel driving rollers rotating in synchronism a corresponding pair of pressure counter-rollers, for pressing the passbook against the driving rollers, and a movable stop adapted to assume selectively a first position for blocking the path of the passbook and a second working position for moving the passbook.

4 Claims, 1 Drawing Figure

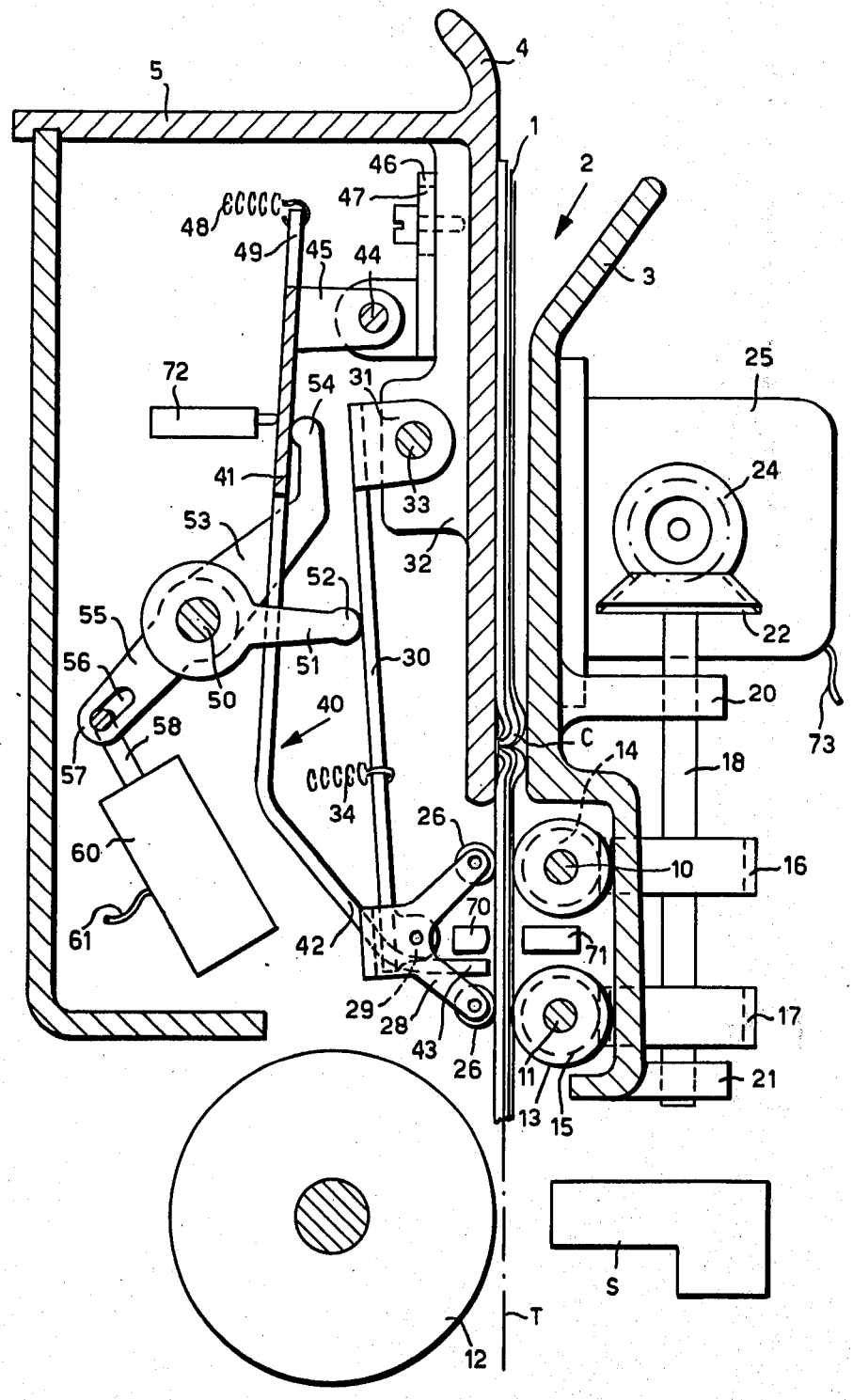
5
4
1
2
3
46
47
48
49
45
44
72
54
31
25
24
41
33
53
32
52
22
55
51
30
56
50
20
40
73
58
C
14
57
18
34
26
60
10
16
61
70
42
71
29
28
17
43
26
11
21
13
15
S
T
12

AUTOMATIC DOCUMENT FEED DEVICE

BACKGROUND OF THE INVENTION

1. Field of the Invention

The present invention relates to an automatic document feed device, suitable for an accounting or other such office machine, and more particularly the device comprises a pair of driving rollers having parallel axes and rotating in synchronism, a corresponding pair of pressure counter-rollers adapted to be actuated to press the document against the driving rollers in order to move the documents, and a movable stop for arresting the document at a predetermined reference position from which controlled movement is effected by means of the rollers.

In some types of accounting terminals used at counter-positions, it is necessary to print commercial transactions in account books which have their spines or backs parallel to the printing lines. Therefore, when printing must be carried out on the upper page, the spine must pass below the driving rollers during the movement of the book, assuming such movement to be downwards.

2. Description of the Prior Art

In a known device for handling account books, a single row of constantly rotating driving rollers is provided. A corresponding row of pressure counter-rollers is always urged against the driving rollers by a spring, so that on introduction of the book it must raise the counterrollers to be able to come into engagement with the driving rollers, which act on the book by friction. A device of this kind has a dual drawback; in fact, if the inner leaves of the book have their edges slightly lifted because of previous turning of the leaves, the pressure counter-rollers may ripple the leaves of the book, so that the printing may fall on a line that is already printed or astride two lines. Moreover, when the book must be fully inserted to print on the first lines, the spine must pass below the pressure counter-roller, with the risk of the movement of the book being obstructed, since the spine does not succeed in overcoming the counter-roller.

SUMMARY OF THE INVENTION

With a view to obviating such drawbacks, the present invention provides a document feeding device comprising a pair of driving rollers having parallel axes, means for rotating the rollers in synchronism as to peripheral velocity, a pair of pressure counter-rollers for pressing the document against the driving rollers to be fed thereby, a movable stop for arresting the document in a reference position from which, in use, it is fed by the rollers, and control means operable between two settings, namely a first setting in which the movable stop is positioned to arrest the document and the counter-rollers are retracted from the driving rollers, and a second setting in which the stop is retracted to allow the document to be fed from the reference position and the counter-rollers are urged towards the driving rollers to allow the latter to feed the document.

BRIEF DESCRIPTION OF THE DRAWING

The FIGURE is a cross-section of the device.

DETAILED DESCRIPTION OF THE INVENTION

The device is formed as a so-called modular unit, that is it constitutes an independent assembly which can be fixed to a basic accounting machine of known type, which is not described in detail.

Referring to the FIGURE of the accompanying drawing, a book 1 is introduced into a slot 2 between a front guide 3 and a rear guide 4 fixed to two side pieces not visible in the drawing. The rear guide 4 is extended to the rear (to the left in the drawing) by a covering surface 5. Two shafts 10 and 11 parallel to one another and to the platen 12 can rotate in the side pieces. Mounted on the shafts 10 and 11 and fast therewith are rollers 13 of soft material, for example rubber, for driving the book 1 along by friction. On the shafts 10 and 11 there are also fixed fast two gears of equal diameter 14 and 15 having helical teeth which mesh with two corresponding gears 16 and 17 fixed on a shaft 18 having its axis vertical and rotatable in a pair of supports 20 and 21 formed on the front guide 3. At the upper end of the shaft 18 there is fixed a bevel gear 22 meshing with a corresponding gear 24 keyed rigidly to the shaft of a motor 25.

Pressure rollers 26 rotatable on a bail 28 rockably mounted at the lower end 29 of a resilient lever 30 bear against the rollers 13. The resilient lever 30 is hinged by a lug 31 to a rib 32 of the rear guide 4 by means of a pin 33. A spring 34 urges the lever 30 clockwise to move the counter-rollers 26 away from the driving rollers 13, without bending resilient lever 30, because the bending strength of lever 30 is very high compared to the force applied by spring 34.

A lever 40 is formed by an elongated plate 41 extending horizontally parallel to the rear guide 4. From the lower portion of the plate 41 there extend projections 42 suitably bent so as to be able to block the path of the book 1 with their ends 43 in a position very close to the lower counter-rollers 26. The lever 40 can pivot on a pin 44 which connects lugs 45 fixed to the upper portion of the plate 41 to brackets 46 fixed to the rear guide 4. Each of the brackets 46 has a slot 47 which enables it to be shifted vertically to make a vertical adjustment of the position of the lever 40. A spring 48 is connected to the upper end 49 of the lever 40. On a horizontal shaft 50 there is fixed rigidly a first lever arm 51 which bears by means of its end 52 against the lever 30.

A second lever arm 53 is fixed to the shaft 50 and acts by means of its end 54 against the plate 41 of the lever 40. A third lever arm 55, likewise fixed to the shaft 50, engages by means of a slot 56 formed at its end 57 with a rod 58 connected to the movable armature of a solenoid 60. When the book fed device is mounted on the basic accounting machine, the path of the book 1, indicated by the line T in the drawing, is tangent to the platen 12, in correspondence with the printing element S indicated diagrammatically in the drawing, inasmuch as this may be of any known type, for example a wire printing head.

The operator introduces the book 1 into the slot 2, activating a microswitch (not shown); consequently, a signal arrives from the basic machine on a wire 61 for activating the electromagnet 60, which causes the shaft 50 to rotate clockwise through the medium of the lever 55. The end 52 of the lever 51 then swings downwardly, releasing the lever 30 which, under the action of the spring 34, turns clockwise, moving the counter-rollers 26 away from the rollers 13. At the same time, the lever 53 also swings clockwise and its end 54 releases the lever 40 which, under the action of the spring 48, turns anticlockwise, causing the end 43 to block the path T of the book 1. At this point, the operator introduces the book into the slot 2 until it rests on the end 43 of the lever 40 and is thus in a reference position.

In this position, the book 1 interrupts the light beam which is emitted by an optical source 70 and energizes a photosensitive cell 71. When the photocell 71 is de-energized, the basic machine energizes the electromagnet 60 so as to rotate the shaft 50 anticlockwise. The end 52 of the lever 51 is now forced against the lever 30 which, in turn, presses the pressure rollers 26 against the book 1 and, at the same time, the lever 40 is moved away from the path T of the book 1.

A switch 72 is actuated by the lever 40 to signal that the book can now be moved for the printing operation. The basic machine therefore sends to the motor 25 by means of a wire 73 the command for carrying out line spacing and, at the end of the printing operation, for effecting ejection of the book at the top.

If the document 1 is a pass-book of the type having a transverse rib, as shown at C, when rib C passes each roller 26 it moves the roller 26 away, flexing resilient lever 30 slightly against the end 52 of arm 51.

It is pointed out that the motor 25 may be of any known type and, in particular, may be a stepping motor, so that the line spacing command is sent directly to the motor 25 in the form of pulses on the wire 73. If the motor 25 were to be of the d.c. type, it would be necessary to insert a clutch between the motor 25 and the shaft 18 and the central unit of the basic machine would send the command signals for effecting line spacing to the clutch.

What we claim is:

1. An automatic document feed device comprising:

a guide means for guiding a document along a path, a printing station arranged downstream of said guide means along said path, first and second driving rollers disposed on one side of said path upstream of said printing station, said first and second driving rollers being parallel to one another and spaced from one another along said path, means for rotating said first and second driving rollers at substantially identical peripheral velocities, a resilient first lever pivotally attached to said guide means and selectively movable between a first position and a second position, a carrier pivotally mounted on said first lever, first and second pressing rollers mounted on said carrier, said first and second pressing rollers being parallel to one another and being spaced along said path from one another in opposed alignment, respectively, with said first and second drive rollers, whereby said first and second drive rollers and said first and second pressing rollers cooperate to feed said document along said path, stop means movable into said path at a point upstream of said printing station to arrest the movement of said document along said path, said stop means being movable between an operative position blocking said path and an inoperative position away from said path;

rockable lever means pivotally mounted on said guide means and having first and second arms cooperating respectively with said first lever and said stop means, said rockable lever means being movable between a first position wherein said first arm urges said first lever toward said path so that said pressing rollers and said driving rollers are urged toward each other and said second arm engages said stop means to move said stop means to the inoperative position, and a second position wherein said first arm permits said first lever to move away from said path and said second arm allows said stop means to move to the operative position, and electromagnetic means operatively connected to said rockable lever means for selectively moving said rockable lever means between said first and second positions.

2. An automatic document feed device according to claim 1 further comprising means normally biasing said first lever away from said path, and means normally biasing said stop means into the operative position.

3. An automatic document feed device according to claim 1 in which said stop means comprises a second lever pivotally mounted on said guide means and having an end portion movable into said path.

4. An automatic document feed device according to claim 1 wherein said stop means is movable into said path at a point between said first and second pressing rollers.

* * * * *